US008540414B2

(12) United States Patent
Hu

(10) Patent No.: US 8,540,414 B2
(45) Date of Patent: Sep. 24, 2013

(54) DETACHABLE LED BULB

(76) Inventor: Chin-Yi Hu, Dongguan (CN)

( * ) Notice: Subject to any disclaimer, the term of this patent is extended or adjusted under 35 U.S.C. 154(b) by 107 days.

(21) Appl. No.: 13/244,483

(22) Filed: Sep. 25, 2011

(65) Prior Publication Data

US 2013/0077286 A1 Mar. 28, 2013

(51) Int. Cl.
*F21V 29/00* (2006.01)

(52) U.S. Cl.
USPC ..... 362/650; 362/640; 362/646

(58) Field of Classification Search
USPC ..... 362/640, 650, 646, 294, 373
See application file for complete search history.

(56) References Cited

U.S. PATENT DOCUMENTS 8,154,179 B2 * 4/2012 Chen ..... 313/46
8,226,270 B2 * 7/2012 Yamamoto et al. ..... 362/294
8,382,325 B2 * 2/2013 Hisayasu ..... 362/249.02

* cited by examiner

*Primary Examiner* — Anabel Ton

(57) ABSTRACT

A detachable LED bulb which is easy to be maintained is disclosed. The LED bulb includes a circuit board, LED elements, heat dissipating cup, a base and a power driver. The circuit board has two power lines with a second connector. The LED elements are mounted on the circuit. The heat dissipating cup has a hollow portion, a seat for supporting the circuit and a second coupler. The base has a first coupler for coupling with the second coupler. The power driver is received in the hollow portion of the dissipating cup, is electrically connected between the base and the circuit board, and has a first connector for detachably connecting the second connector of the power lines.

4 Claims, 4 Drawing Sheets

DETACHABLE LED BULB

BACKGROUND OF THE INVENTION

1. Technical Field

The invention relates to electric bulbs, particularly to bulbs using LED as a light source.

2. Related Art

Light emitting diodes have extensively applied in various lighting devices because of small volume, low power-consuming and great durability. A typical LED bulb, as shown in FIG. 1, is composed of a heat dissipating cup 10, a base 11, a cover 12, LED elements 13, a circuit board 14 and a power driver 15. The LED elements 13 are mounted on the circuit board 14. The power driver 15 is electrically connected between the base 11 and the circuit board 14 through wires 16, 17.

In such a LED bulb, the dissipating cup 10 and base 11 are integrally formed into a single piece. The connection between the power driver 15 and the circuit board 14 or the base 11 is undetachable. Thus, when the power driver 15 fails and requires to be replaced, the cover 12, circuit board 14 and power driver 15 must be disassembled first and then the wires 16, 17 have to be desoldered. It is very inconvenient for both users and manufactures because the failed bulbs cannot be repaired immediately.

A lifetime of LED elements can usually reach about 200,000 hours or above, while a lifetime of a power driver may only last about 30,000 hours. Thus, LED elements are longer than the power driver by almost seven times in lifetime. Thus, repair or replacement for the power driver within a lifetime of LED elements is unavoidable. However, conventional LED bulbs are very unadvantageous to maintenance of power drivers.

SUMMARY OF THE INVENTION

An object of the invention is to provide a detachable LED bulb, which can be simply maintained by disassembling.

To accomplish the above object, the invention includes a circuit board, LED elements, heat dissipating cup, a base and a power driver. The circuit board has two power lines with a second connector. The LED elements are mounted on the circuit. The heat dissipating cup has a hollow portion, a seat for supporting the circuit and a second coupler. The base has a first coupler for coupling with the second coupler. The power driver is received in the hollow portion of the dissipating cup, is electrically connected between the base and the circuit board, and has a first connector for detachably connecting the second connector of the power lines.

DETAILED DESCRIPTION OF THE INVENTION

Figure 1:
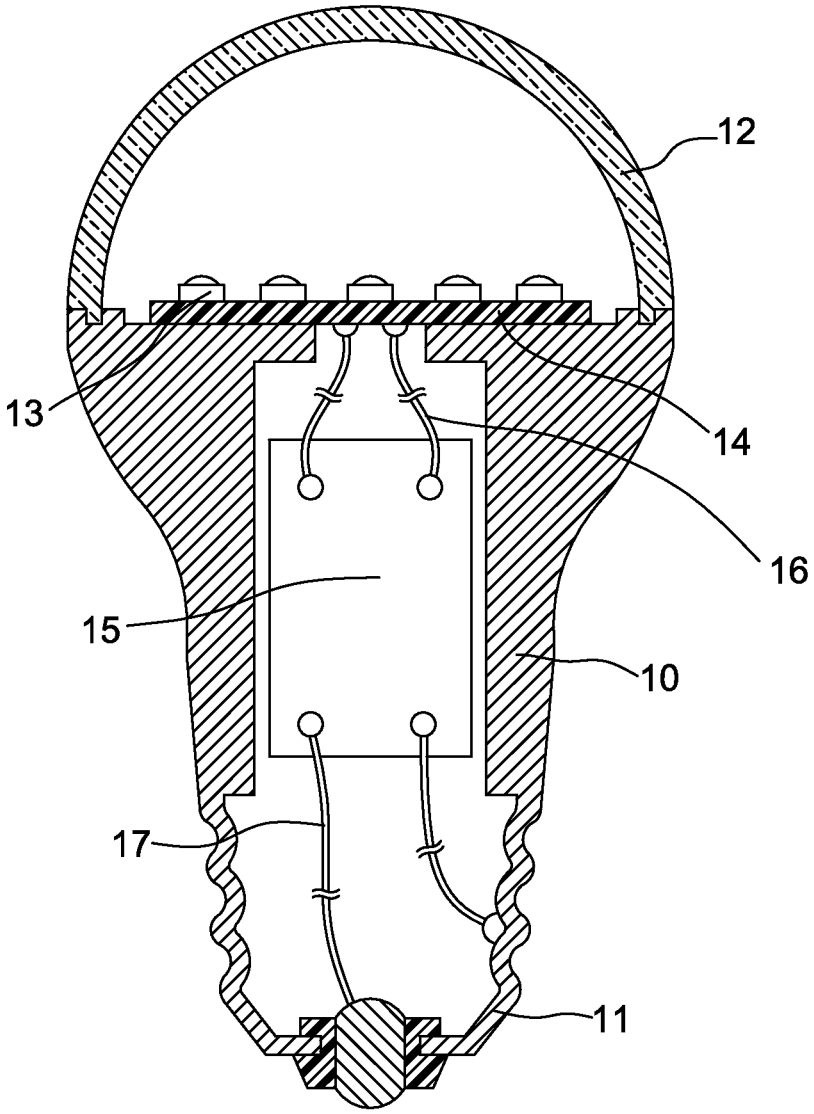
FIG. 1 PRIOR ART
FIG. 1 is a cross-sectional view of a conventional LED bulb.
Figure 2:
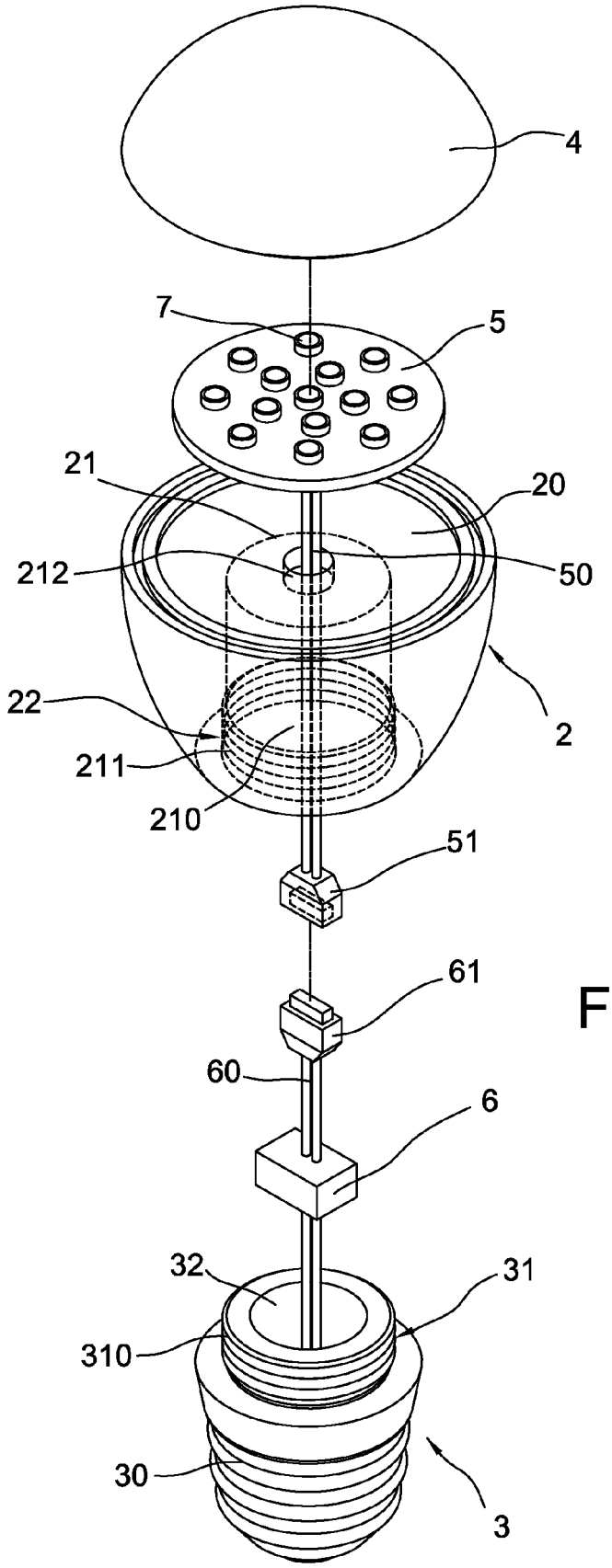
FIG. 2 is an exploded view of a preferred embodiment of the invention.
Figure 3:
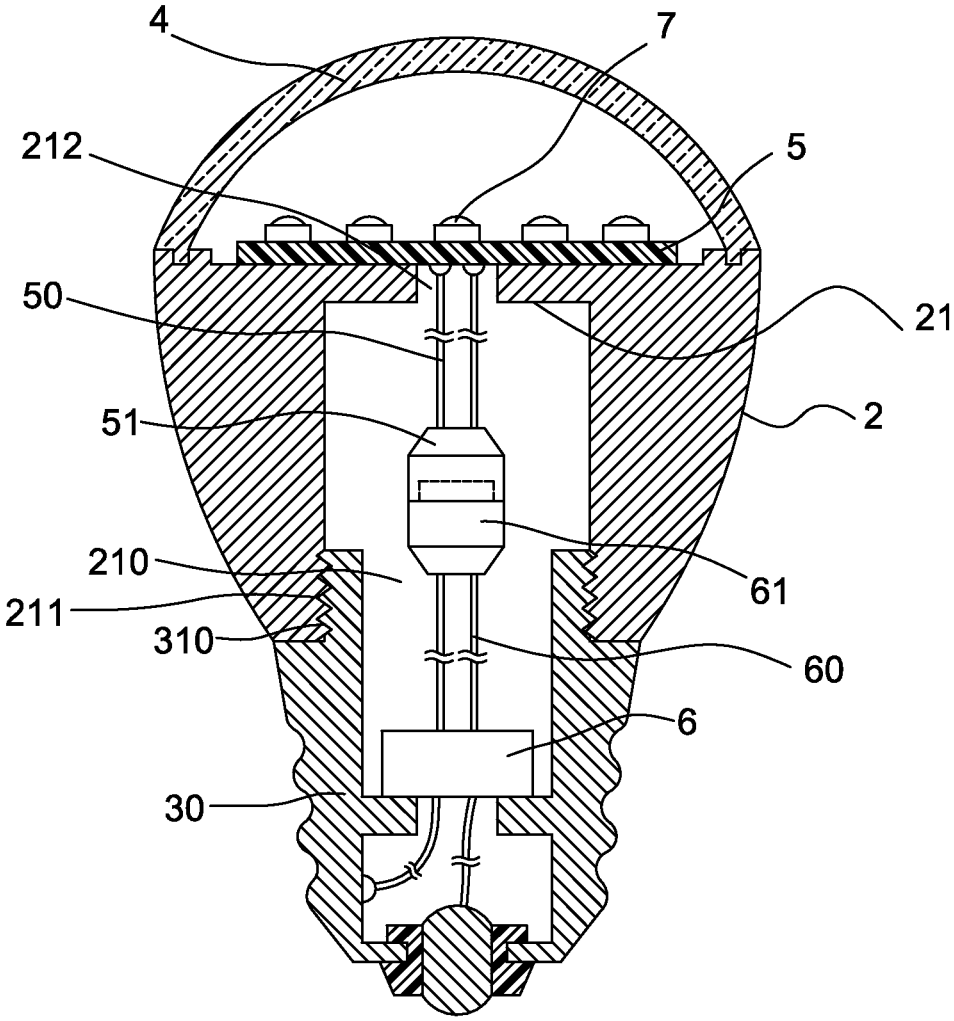
FIG. 3 is a cross-sectional view of the embodiment shown in FIG. 3.

Please refer to FIGS. 1 and 2. The LED bulb of the invention includes a circuit board 5, LED elements 7, heat dissipating cup 2, a base 3, a cover 4 and a power driver 6.

The base 3 includes a conductive cap 30 for introducing external electricity and a first coupler 31 for coupling with the heat dissipating cup 2. In this embodiment, the first coupler 31 is a cylinder with a first thread 310. The first coupler 31 is formed with an opening 32.

The heat dissipating cup 2 is made of a metal material for dissipating heat from the LED elements 7. A hollow portion 20 is formed in the heat dissipating cup 2 for receiving the power driver 6. Also, the heat dissipating cup 2 is formed with a seat 21 for supporting the circuit board 5 and a second coupler 22 corresponding to the first coupler 31. The base 3 and heat dissipating cup 2 can be assembled to integrate with each other. In this embodiment, the second coupler 22 is a threaded hole 210 with a second thread 211. As a result, the base 3 can be screwed into the heat dissipating cup 2 by the connection of the couplers 31, 22, and the base 3 and heat dissipating cup 2 are detachable. Additionally, the seat 21 is formed with a through hole 212 communicating with the hollow portion 20 and the opening 32 for allowing power lines 50 to pass.

The LED elements 7 are mounted on the circuit board 5. One end of the power lines 50 is connected to the circuit board 5, and the other end is disposed with a second connector 51.

The power driver 6 is electrically connected between the base 3 and the circuit board 5. The power driver 6 has two wires 60 with a first connector 61 corresponding to the second connector 51. An electric connection can be made by linking the first connector 61 and the second connector 61. The power driver 6 supplies power to the circuit board 5. The cover 4 is fastened to the heat dissipating cup 2.

There are two connections in the invention, the one is the couplers 31, 22 and the other one is the connectors 61, 51. These connections may be detached to disassemble the bulb. After these connections are detached, the power driver 6 is easy to be replaced. It is very convenient and economical for both users and manufactures.

Figure 4:
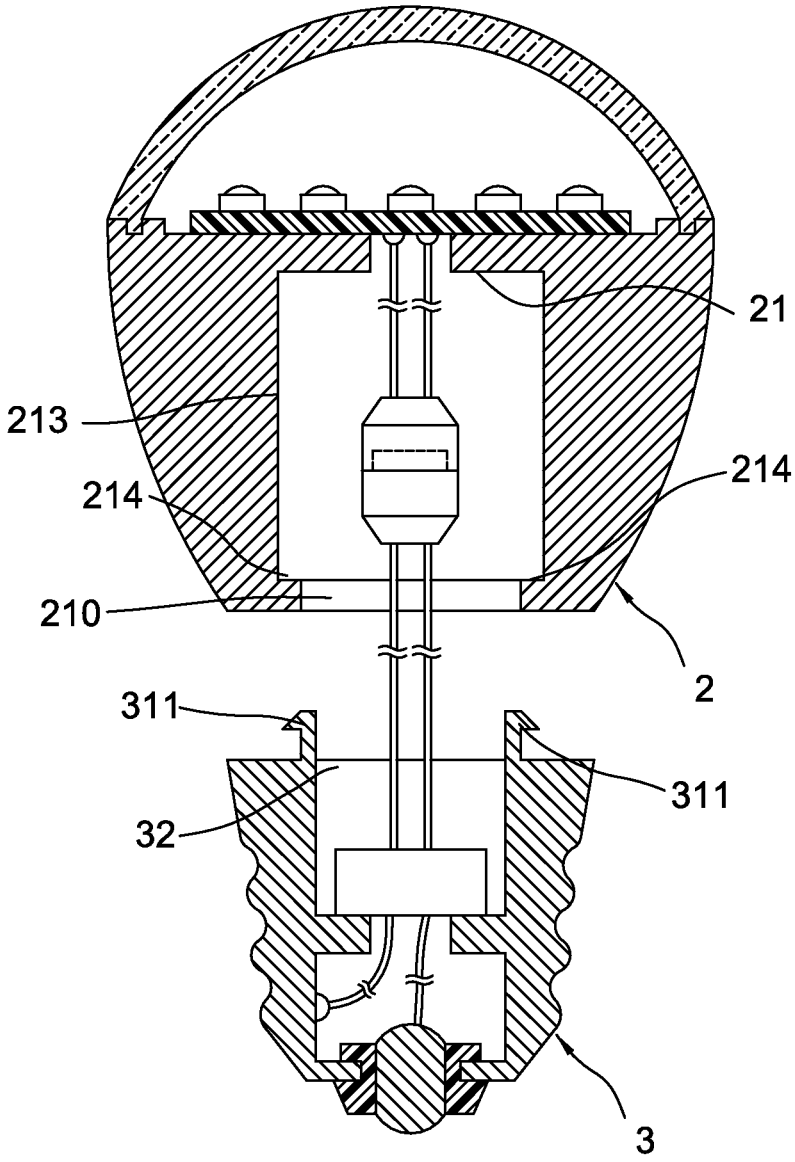
FIG. 4 is a cross-sectional view of another preferred embodiment of the invention.

FIG. 4 shows another preferred embodiment of the invention. In this embodiment, the first coupler 31 is implemented by two hooks 311 towards the heat dissipating cup 2. And the second coupler 22 is implemented by a flange 214 formed on an end of the heat dissipating cup 2. The base 3 and heat dissipating cup 2 can be assemble integrally by engaging the hooks 311 with the flange 214.

While the forgoing is directed to preferred embodiments of the present invention, other and further embodiments of the invention may be devised without departing from the basic scope thereof. As such, the appropriate scope of the invention is to be determined according to the claims.

What is claimed is:

1. A light emitting diode (LED) bulb comprising:

a circuit board having two power lines with a second connector;

an LED element mounted on the circuit board;

a heat dissipating cup, having a hollow portion, a seat for supporting the circuit and a second coupler;

a base having a first coupler for coupling with the second coupler, wherein the base is integrally fastened to the heat dissipating cup by linking the first coupler and the second coupler; and a power driver, received in the hollow portion of the dissipating cup, electrically connected between the base and the circuit board, and having a first connector for detachably connecting the second connector of the power lines.

2. The LED bulb of claim 1, wherein the first coupler of the base has a cylinder with a first thread and an opening in the cylinder, and the second coupler of the heat dissipating cup is a threaded hole with a second thread corresponding to the first thread.

3. The LED bulb of claim 2, wherein the seat is formed with a through hole communicating with the threaded hole.

4. The LED bulb of claim 1, wherein the first coupler is two hooks towards the heat dissipating cup, the second coupler is a flange formed on an end of the heat dissipating cup, and the base and heat dissipating cup are assembled integrally by engaging the hooks with the flange.

* * * * *